United States Patent [19]

Barten et al.

[11] Patent Number: 4,667,706

[45] Date of Patent: May 26, 1987

[54] APPARATUS AND METHOD FOR STORING FILAMENTOUS MATERIAL FOR USE IN A WEAVING MACHINE

[75] Inventors: Antonius M. Barten, Deurne, Netherlands; Georg Senn, Rüti, Switzerland

[73] Assignee: Sulzer Brothers Limited, Winterthur, Switzerland

[21] Appl. No.: 820,969

[22] Filed: Jan. 22, 1986

[30] Foreign Application Priority Data

Jan. 29, 1985 [EP] European Pat. Off. ..... 85 810029.0

[51] Int. Cl.[4] ..... D03D 47/36

[52] U.S. Cl. ..... 139/452

[58] Field of Search ..... 139/452; 226/119, 97; 242/47.01

[56] References Cited

U.S. PATENT DOCUMENTS

| | | | |
|---|---|---|---|
| 3,712,526 | 1/1973 | Hanousek et al. | 139/452 |
| 3,902,644 | 9/1975 | Bous | 226/44 |
| 4,436,123 | 3/1984 | Senn et al. | 139/452 |
| 4,479,518 | 10/1984 | Kiwior | 139/452 |

FOREIGN PATENT DOCUMENTS

| | | | |
|---|---|---|---|
| 2215003 | 10/1973 | Fed. Rep. of Germany . | |
| 2239561 | 2/1974 | Fed. Rep. of Germany . | |
| 2291304 | 6/1976 | France . | |
| 46-36509 | 10/1971 | Japan | 139/452 |
| 48-27219 | 8/1973 | Japan | 139/452 |
| 261743 | 5/1964 | Netherlands . | |

*Primary Examiner*—Henry S. Jaudon

*Attorney, Agent, or Firm*—Burns, Doane, Swecker & Mathis

[57] ABSTRACT

In a weft yarn storage device for weaving machines a cover (13) extending over approximately 120° is provided above a rotating disc (2) which receives the yarn deposit (8). The cover (13) is secured against rotation by a bearing (14) and acts on the disc (2) by merely a slight pressure produced by its own weight. An ordered yarn deposit (8) is therefore produced. The speed of the disc (2) and the speed at which the nozzle (6) feeds the yarn (7) are so adapted to one another that the yarn deposit (8) extends at most as far as the intersection (42) of the tangent (43) with the disc (2) (center line (40) of the support surface (5)). The nozzle (6) is disposed directly on the leading edge (21) of the cover (13). A very reliable yarn entry between the support surface (5) and the cover (13) is therefore provided, as is also an orderly takeoff of yarn from the support surface (8) starting at (42).

8 Claims, 4 Drawing Figures

APPARATUS AND METHOD FOR STORING FILAMENTOUS MATERIAL FOR USE IN A WEAVING MACHINE

The invention relates to apparatus for use in weaving machines for storing filamentous material (e.g., weft yarn) for picking or insertion into the warp yarn shed during the weaving process. There is provided a device comprising a rotating material-carrying disc and, directed theretowards, a nozzle for supplying air and yarn, the device also having an eye which is disposed on the picking side of the weaving machine and which is operative to supply to the picker the yarn drawn off the disc.

The invention also relates to a method of operating the device.

A conventional device of this kind is disclosed by DE-PS 2 215 003 U.S. counterpart U.S. Pat. No. 3,902,644 and such disclosure is incorporated herein by reference. In such a device, a feed nozzle which is reciprocated transversely of the direction of disc rotation lays the yarn for storage on the disc in loop form. After storage the yarn is withdrawn substantially perpendicularly to the surface of the support disc. The loop-like deposit of yarn may readily become disordered, with the result that discrete loops become superposed upon one another. Withdrawal of the stored yarn may be disturbed because a number of superposed loops are often withdrawn simultaneously instead of consecutively. The yarn must be withdrawn perpendicularly to the disc in this construction since, if withdrawal were carried out in the direction of the disc plane, there would be an increasing tendency for yarn loops disposed one above another to be withdrawn simultaneously.

It is the object of the invention to provide a storage device which is improved more particularly in this aspect.

In the device according to the invention, a cover element is disposed with slight pressure, preferably produced by its own weight, on the disc, the material being stored in the form of a loop-like deposit between the disc and the cover element.

In the corresponding method of operating the device, the speed of the disc and the feed rate of the material to be stored thereon are so adapted to one another that the end of the loop-like material deposit stored on the disc extends at most to near the intersection between, on the one hand, the disc and, on the other hand, the tangent from the eye to the retreating portion of the disc.

As tests show, the cover element (cover) helps to ensure very uniform depositing of the loops without entanglement of the yarn, for example, without individual loops being disposed one above another. More particularly, however, the material coming from the supply nozzle and which it is required to place on the disc and which will be referred to hereinafter by way of example as yarn makes a clean entry. The supply nozzle and, therefore, the entering part of the yarn can be shifted into a convenient sector near the eye, thus ensuring that the stored deposit is consumed entirely when the yarn is withdrawn during picking and, advantageously, a short extra piece is drawn directly from the nozzle. This can be achieved by a withdrawal direction disposed in the plane of the disc, thus ensuring very reliable operation.

Advantageously, the cover can extend over a sector near the eye of, for example, 120° over the disc, and the yarn deposit extends over approximately 90°. Consequently and advantageously, at the start of picking the yarn is drawn off a disc portion disposed at the intersection between, on the one hand, the disc and, on the other hand, the tangent from the eye to the retreating portion of the disc. The resistance to drawing off then becomes relatively reduced since only the slight friction of a relatively short portion of the disc has to be overcome by the yarn.

Other features will become apparent from the following description of embodiments in association with the drawings and the claims.

DETAILED DESCRIPTION OF THE PREFERRED EMBODIMENTS

Figures 1, 3, 4:
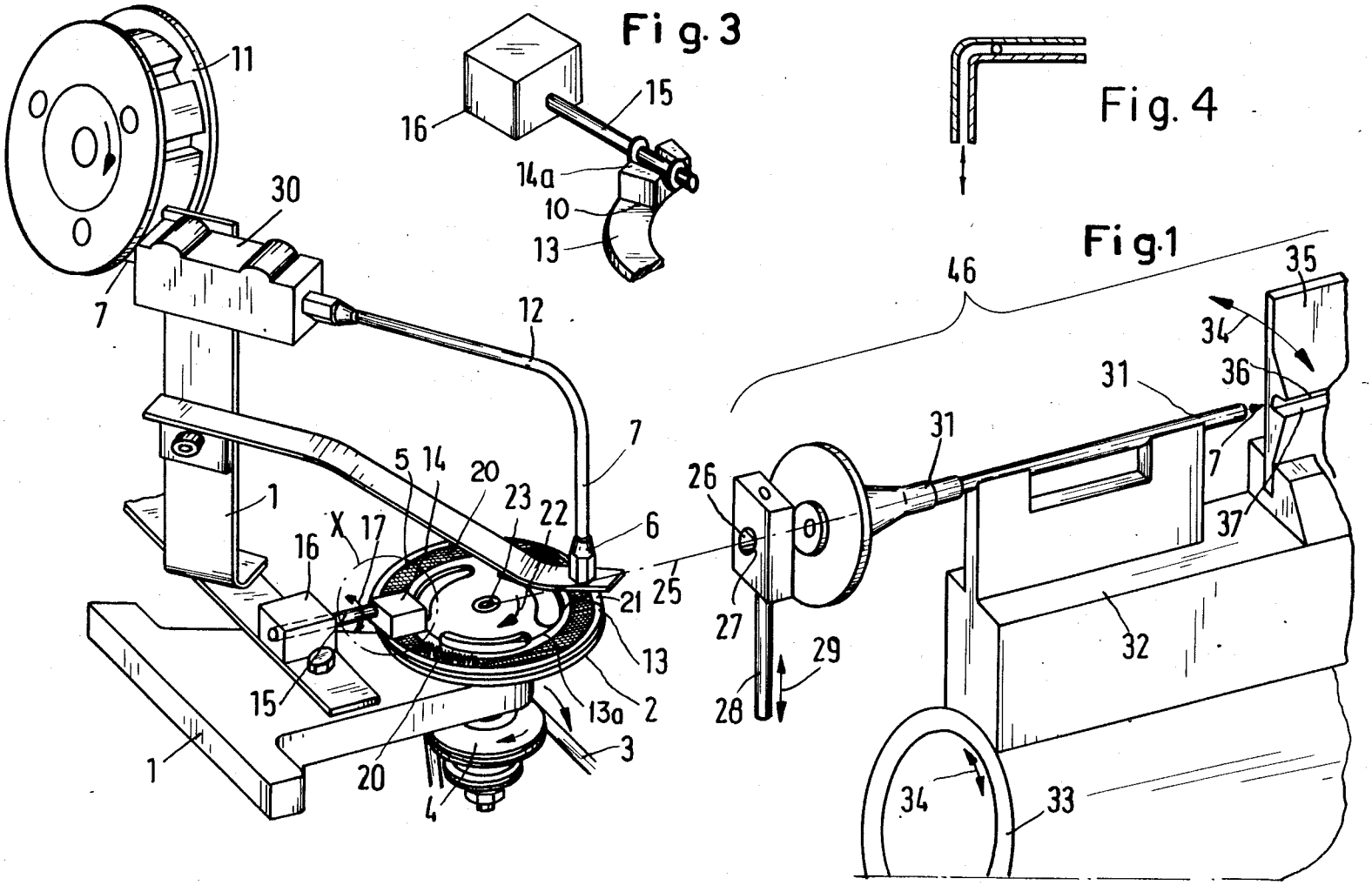
FIG. 1 is a perspective view of storage apparatus according to the invention on a weaving machine which is only partly visible.
FIG. 3 illustrates a detail of a variant in the portion X of FIG. 1.
FIG. 4 is a side schematical representation of the yarn brake of FIG. 1.

A dished support disc 2 of a diameter of, for example, 140 mm is mounted on a frame 1 disposed on a loom or weaving machine 46 represented merely by the picking side. That is, there is illustrated only that side part of the loom from which a weft yarn is inserted periodically into the open warp yarn shed during the weaving process. The illustrated side part of the loom would be at the left of a viewer standing in front of and facing the loom.

The drive of the weaving machine rotates the disc 2 continuously by way of an endless belt drive 3 and a pulley or roller 4. The disc 2 carries, (for example, on an outer, annular part of its upper face) a support surface member 5 which may, for example, be made of velour or needle felt or other suitable material. It normally is preferred that the surface 5 have a texture which will tend to stabilize the positioning of the weft yarn deposited thereon from a supply nozzle 6. For example, upstanding components or bristle-like elements 20 on the top of the support surface member 5 contact the weft and the yarn can be laid in a loop-like yarn deposit 8 (FIG. 2) as the disc rotates in the direction indicated by an arrow 22. The yarn 7 is supplied to the nozzle 6 by way of a continuously rotating feed drum 11 driven in synchronism with the drive of the weaving machine, by way of a conveying nozzle 30 and by way of a feed tube 12, the yarn being drawn off a yarn package such as a bobbin (not shown) supported on or near the machine.

A cover 13 is positioned above the support surface 5 with at least a portion of the cover in contact with the support surface, in an area which follows the nozzle 6 in the direction of rotation of the disc 2. This cover preferably is formed largely of transparent material, such as of plexiglass. As weft yarn is deposited on the support surface 5, this surface moves in the direction 22 to bring the yarn deposit 8 beneath the leading edge of the cover 13.

The effective arcuate extent of the cover 13 is preferably about 120° . See the sector B in FIG. 2. Suitable means (not illustrated in FIGS. 1 and 2) connect the effective length of the cover 13 with a bearing member 14 for movement therewith. This bearing member 14 is rotatably connected to a rod 15 (in any known manner) which is secured in a support 16 carried on the frame 1. The cover 13 can therefore pivot around the rod 15 as indicated by an arrow 17.

Figure 2:
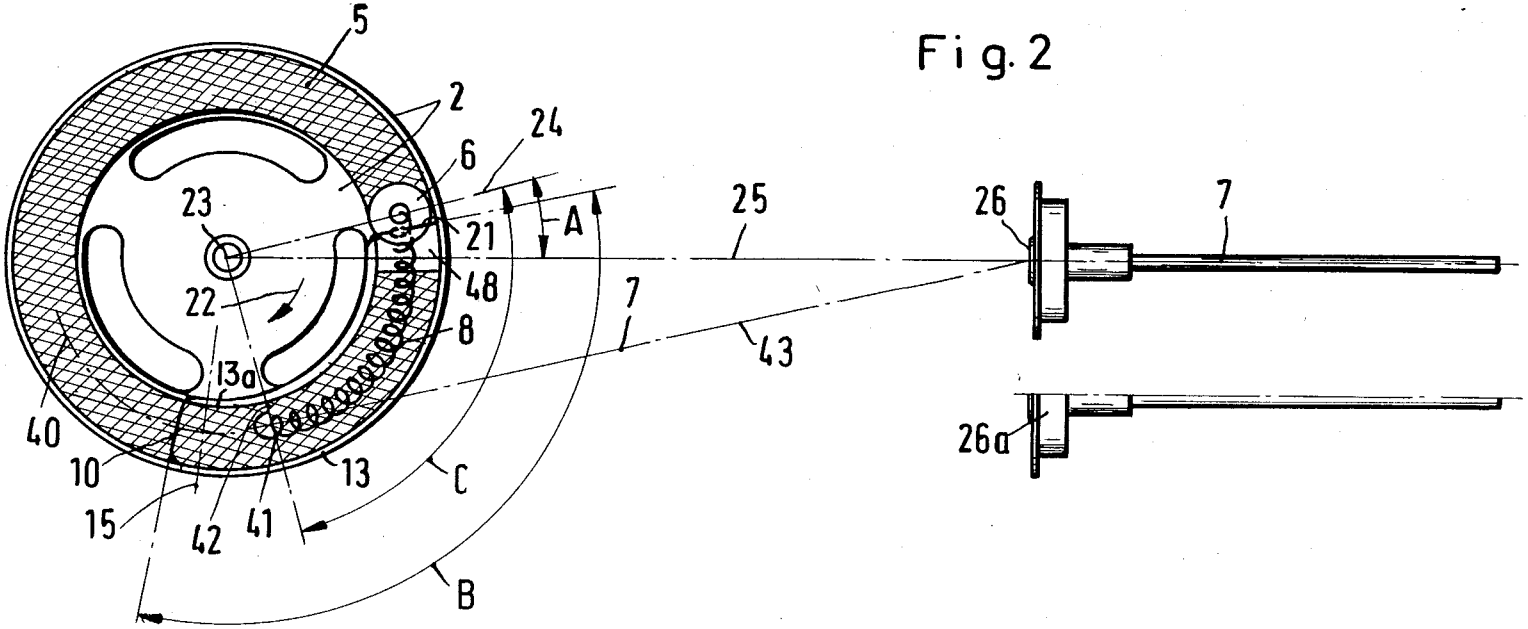
FIG. 2 is a plan view of a detail of FIG. 1.

The leading end edge 21 of the cover 13 preferably is constituted by a metal element 48 (FIG. 2). This edge 21 is disposed immediately after the supply nozzle 6 as considered in the direction of rotation (arrow 22) of the disc 2. The cover 13 has an end edge 10. The location of the trailing end edge 10 (FIG. 2) or of the location of the bearing 14 will determine the maximum arc length over which a yarn deposit 8 might be contacted by the cover 13.

Referring to FIG. 2, the nozzle 6 is positioned along a radius 24 defining an angle A between the connecting line 25 which extends between the eye 26 and the axis 23 of the disc 2. The nozzle 6 may be positioned within an approximately 30° sector as measured from the line 25 in the opposite direction to the arrow 22 toward the radius 24.

The eye 26 comprises a yarn brake 27 of any well-known type adapted to be operated by way of linkage 28 in the direction of an arrow 29. A main picking nozzle 31 is disposed on sley 32 of the machine and is reciprocated by way of a hollow shaft 33 as indicated by an arrow 34. Also illustrated diagrammatically are a reed 35, a picking line 36 and a yarn-guiding channel 37.

Referring again to FIG. 2, that end of the yarn deposit 8 which is farthest from the nozzle 6 has been designated 41. In this view, the line 43 is a straight line which intersects the center of the eye 26 and which is tangent, at point 42, to the circular center line 40 of the support surface 5.

The disc speed produced by the drive at 3, 4, for example, of 200 $min^{-1}$ and the speed at which the drum 11 feeds the yarn 7, for example, a speed of 18 m/sec, are so adapted to one another that end 41 of the deposit 8 is disposed near the point 42. As will be evident to persons skilled in the art, the exact location of the remote end 41 of the yarn deposit 8 at the moment when a weft insertion operation (a pick) is initiated will be a function of the time interval between successive weft insertion operations and the linear speed of the center line 40 of the support surface 5 carried by the rotating disc 2.

When picking starts, the parts being positioned as shown in FIG. 2, the weft yarn 7 will be disposed on the tangent 43 as it is fed to the conveying nozzle 31. That is, the weft yarn will lead away from the eye 26 approximately on the line 43, between the unobstructed outside edge portions of the support surface 5 and the cover 13, and part way across the support surface 5 to the remote end 41 of the yarn deposit 8. The main nozzle 31 is now supplied with air so that the weft yarn 7 is initially drawn off the end 41 of the deposit 8. Yarn is also laid continuously on the disc 2 by the nozzle 6, the disc 2 continuing to rotate. Picking proceeds so rapidly that during the movement of the eye 26 from its rear position, which is the top position in FIG. 2 and is furthest away from the beating-up of the cloth, towards its front reversal position 26*a*, all the yarn of the deposit 8 is consumed during picking and an extra piece of yarn is pulled out of the tube 12 so as to be deposited on the surface 5 and under the cover 13. At the end of picking the yarn brake 27 brakes the picked yarns 7. A fresh deposit 8 is now laid on the disc 2.

In the variant of FIG. 3 the cover element 13 is floatingly mounted—i.e., the shaft 15 merely prevents the element 13 from following the rotation of the disc 2. The bearing 14*a* is open at the top.

As will be apparent, the yarn 7 which is drawn from the deposit 8 is drawn off the disc 2 in the plane thereof, which is the same as the plane of the drawing in FIG. 2, and is not drawn off, for example, perpendicularly to the disc 2.

In an alternative method of operation, the speed of disc rotation and the speed at which the yarn 7 is supplied by the nozzle 6 are so adapted to one another that the yarn deposit 8 extends over a shorter distance, for example, only approximately 60°, than the approximately 90° arc C shown in FIG. 2. The deposit 8 should not extend far beyond the intersection 42, for if it does the yarn would have to be drawn off over a relatively large portion of the support surface 5 with increased friction at the beginning of picking and the risk of entanglement of the yarn would increase.

It has been assumed as regards the support surface 5 that the same is made of a substantially air-impervious material and the air discharges, with a change in its flow direction, in a direction parallel to the disc plane—i.e, the plane of the drawing in FIG. 2. However, in a variant, an air-pervious, for example, screen-like support surface 5 through which the discharging air can pass can be used.

The arc length C of the deposit 8 can, for example, for a given disc speed and for a given yarn-feeding speed of the nozzle 6, be shorter when, for example, the picking length or cloth width of the machine is smaller. However, another way of achieving this reduced picking length is for the arc length of the deposit 8 to be equal to the amount C when disc speed is increased correspondingly. In this event the discrete loops of deposit 8 are pulled further apart from one another and are therefore not so close together.

In one embodiment the axis 23 is positioned horizontally instead of vertically in FIG. 1 so that the disc plane is vertical; in this case the cover 13 may be pressed against the support member 5 with a slight force by one or more springs or by other suitable means.

The axis 23 can be disposed above or below the connecting line 25 in FIG. 2 so that the disc 2 can be disposed higher or lower in FIG. 2. The vertical location of the plane of the support surface 5 has been shown in FIG. 1 as being about the same as the vertical location of the center of the eye 26. However, variations in this arrangement are possible if such is desired.

Still other modifications and variations will suggest themselves to persons skilled in the art. Hence, the foregoing detailed description of certain embodiments is intended as exemplary in nature.

What is claimed is:

1. A device of use in weaving machines for storing filamentous material for picking, the device comprising a rotation material-carrying disc and, directed theretowards, a nozzle for supplying air and said material, the device also having an eye disposed on the picking side of the weaving machine and which is operative to supply to the picker the material drawn off the disc, wherein a cover element is positioned with slight pressure on the disc the cover element extends only over a disc sector (B) near the eye, the material being stored in the form of a loop-like deposit between the disc and the cover element.

2. A device according to claim 1, wherein an end edge (21) of the cover element is disposed immediately after the nozzle (6) as considered in the direction of disc rotation.

3. A device according to claim 1, wherein the nozzle (6) is disposed in a sector (A) extending approximately 30° in a direction opposite to the direction of disc rotation from a line (25) connecting the disc axis (23) and the eye (26).

4. A device according to claim 1, wherein a bearing (14) secures the cover element (13) against rotation in the direction (22) of disc rotation and is connected at that end (10) of the cover element which is remote from the nozzle (6).

5. A device according to claim 4, wherein the bearing (14*a*) is open at the top and the cover element (13) is mounted floatingly thereto.

6. A method for operating a device for storing filamentous material for use in a weaving machine, the device including a rotatable disc and an eye element for receiving the material from the disc; driving the disc at a predetermined speed; feeding the material to the disc at a predetermined rate; intermittently storing the material on the disc; and coordinating the driving speed and the feed rate so that an end of the material stored on the disc extends at the most to an intersection defined by the disc and a tangent from the eye to a portion of the disc and consuming the entire stored deposit of the material during a predetermined time period.

7. A weft yarn supply system for a loom, comprising a yarn storage surface movable through a closed path having a portion providing a yarn storage zone, means for depositing yarn onto said moving surface at a first location near an end of said storage zone so that the deposited yarn may move with said surface through said storage zone, yarn guiding and inserting means at a side of the loom for periodically pulling lengths of weft yarn from said storage zone in a direction extending generally parallel to said storage surface in said storage zone, and cover means lightly pressing said weft yarn against said surface in said storage zone to exert control forces for reducing the risk of entanglements as lengths of weft yarn are pulled from said storage zone, said yarn storage surface moves through an annular path about an axis extending generally perpendicularly with respect to the plane of said surface, wherein said first location at which yarn is deposited on said surface is located on one side of the point of closest approach of said annular path to said yarn guiding and inserting means, and wherein the rate of movement of said surface and the interval between weft length insertions into the shed are so related that, at the beginning of a period of weft length insertion, yarn is withdrawn from said storage zone at a second location on the opposite side of the point of closest approach of said annular path to said yarn guiding and inserting means.

8. A system as claimed in claim 7, wherein the angular length of said storage zone is not greater than about 120°.

* * * * *